US009802215B2

(12) United States Patent
Batt et al.

(10) Patent No.: US 9,802,215 B2
(45) Date of Patent: Oct. 31, 2017

(54) METHOD AND SYSTEM FOR APPLYING A COATING

(71) Applicant: The Boeing Company, Chicago, IL (US)

(72) Inventors: Edward John Batt, Bothell, WA (US); David Michael Kumpf, Lake Stevens, WA (US)

(73) Assignee: THE BOEING COMPANY, Chicago, IL (US)

( * ) Notice: Subject to any disclaimer, the term of this patent is extended or adjusted under 35 U.S.C. 154(b) by 194 days.

(21) Appl. No.: 14/618,174

(22) Filed: Feb. 10, 2015

(65) Prior Publication Data

US 2016/0228904 A1 Aug. 11, 2016

(51) Int. Cl.

| | |
|---|---|
| ***B05C 1/08*** | (2006.01) |
| ***B05D 3/12*** | (2006.01) |
| ***B05D 1/28*** | (2006.01) |
| *B05C 11/02* | (2006.01) |

(52) U.S. Cl.

CPC ..... *B05C 1/0891* (2013.01); *B05C 1/0813* (2013.01); *B05C 1/0821* (2013.01); *B05D 1/28* (2013.01); *B05D 3/12* (2013.01); *B05C 11/025* (2013.01); *B05C 11/028* (2013.01)

(58) Field of Classification Search

CPC ... B05C 1/0891; B05C 1/0813; B05C 1/0821; B05C 11/025; B05C 11/028; B05D 5/00; B05D 3/12; B05D 1/28

USPC ..... 118/221, 223, 255, 674, 708, 712; 427/428.01, 207.1

See application file for complete search history.

(56) References Cited

U.S. PATENT DOCUMENTS

| | | | | |
|---|---|---|---|---|
| 2,209,761 | A * | 7/1940 | Berry | D21F 5/02 100/162 R |
| 2,649,755 | A * | 8/1953 | Jones | B05C 1/0834 118/111 |
| 4,484,976 | A | 11/1984 | Despins | |
| 4,589,950 | A | 5/1986 | Sekavec, Jr. | |
| 5,464,474 | A * | 11/1995 | Nishimoto | B08B 1/007 118/104 |
| 5,520,383 | A * | 5/1996 | Amagai | B41J 11/42 271/265.01 |
| 6,494,245 | B1 | 12/2002 | Simone | |
| 6,789,974 | B2 | 9/2004 | Atkinson et al. | |
| 6,849,125 | B1 * | 2/2005 | Miller | B05C 1/02 118/114 |
| 7,086,800 | B2 | 8/2006 | Major et al. | |

(Continued)

*Primary Examiner* — Laura Edwards
(74) *Attorney, Agent, or Firm* — Yee & Associates, P.C.

(57) ABSTRACT

A method and apparatus are presented. A first roller has a sensor that senses a speed of the workpiece while the workpiece is in contact with the first roller and moving relative to the first roller causing the first roller to rotate. The sensor senses the speed of the workpiece from a rotation of the first roller. A second roller causes the sealant on the second roller to be applied to a surface of the workpiece when the workpiece is in contact with the second roller and moving relative to the second roller. The second roller is rotationally linked to the first roller. A third roller causes the sealant on the surface of the workpiece to spread on the surface when the workpiece is in contact with the third roller and moving relative to the third roller. The third roller is rotationally linked to the second roller.

19 Claims, 10 Drawing Sheets

(56) References Cited

U.S. PATENT DOCUMENTS

| | | | | |
|---|---|---|---|---|
| 7,206,665 | B2 * | 4/2007 | Groppe | B29C 70/32 156/359 |
| 7,361,132 | B2 * | 4/2008 | Ratzel | B31D 5/0047 493/340 |
| 2010/0038029 | A1 | 2/2010 | Carlsen et al. | |

* cited by examiner

METHOD AND SYSTEM FOR APPLYING A COATING

BACKGROUND INFORMATION

Field

The present disclosure relates generally to applying a coating. More particularly, the present disclosure relates to a method and apparatus for applying sealant to an elongated workpiece.

Background

In manufacturing assemblies, various types of coatings may be applied to different workpieces of the assembly. For example, without limitation, these coatings may be selected from at least one of a sealant, an adhesive, a primer, an optical coating, a corrosive-resistant coating, a lacquer, paint, or other suitable types of coatings.

These coatings may provide the structures with desired characteristics for the performance of the assembly. As an example, a sealant may be applied to a workpiece prior to being attached to another structure. It may be desirable for a layer of sealant to be within specified tolerances. For example, sealant may be desirably applied to a preselected area on the workpiece. Further, it may be desirable to have a substantially even layer of sealant.

Currently, a sealant may be applied to an elongate workpiece by a human operator. However, applications of sealant may vary from operator to operator. Applications of sealant by the same operator may not be within tolerance. Also, an application of sealant by a human operator may not be even across the surface of the workpiece.

The application of sealant by a human operator may take more time than desired. In addition, it may be undesirable for human operators to be exposed to coatings such as sealant for extended amounts of time. Accordingly, it may be desirable to have a method and system that take into account one or more of the issues discussed above as well as other possible issues. For example, it may be desirable to have a method and system that applies sealant to a workpiece.

SUMMARY

An illustrative embodiment of the present disclosure provides a system for applying a sealant to a workpiece. The system comprises a first roller, a second roller, and a third roller. The first roller has a sensor that senses a speed of the workpiece while the workpiece is in contact with the first roller and moving relative to the first roller causing the first roller to rotate. The sensor senses the speed of the workpiece from a rotation of the first roller. The second roller causes the sealant on the second roller to be applied to a surface of the workpiece when the workpiece is in contact with the second roller and moving relative to the second roller. The second roller is rotationally linked to the first roller. The third roller causes the sealant on the surface of the workpiece to spread on the surface when the workpiece is in contact with the third roller and moving relative to the third roller. The third roller is rotationally linked to the second roller.

A further illustrative embodiment of the present disclosure provides a system for applying a sealant to a workpiece. The system comprises a first roller, a biasing system, a second roller, a sealant application system, and a third roller. The first roller is configured to sense a speed of the workpiece, such that in operation, the first roller senses the speed of the workpiece. The biasing system is associated with the first roller. The biasing system is configured to bias the workpiece into contact with the first roller, such that in operation, the biasing system biases the workpiece into contact with the first roller. The second roller is configured to apply the sealant to the workpiece, such that in operation, the second roller applies the sealant to the workpiece. The second roller is rotationally linked to the first roller. The sealant application system is associated with the second roller. The sealant application system comprises a sealant manifold having an inner surface substantially complementary to the second roller, and a sealant dispensing system. The third roller is configured to spread the sealant across the workpiece, such that in operation, the third roller spreads the sealant across the workpiece. The third roller is rotationally linked to the second roller.

Another illustrative embodiment of the present disclosure provides a method for applying sealant to a workpiece. The method comprises sensing a speed of the workpiece with a first roller. The sealant is applied to the workpiece with a second roller rotationally linked to the first roller. The sealant is spread on the workpiece with a third roller rotationally linked to the second roller.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account one or more different considerations. For example, the illustrative embodiments recognize and take into account that a mating surface of a workpiece may have sealant applied prior to being secured to a second structure. The illustrative embodiments further recognize and take into account that an automated application of the sealant may be desirable. The illustrative embodiments also recognize and take into account that consistent sealant coverage and consistent sealant thickness may be desirable. Currently, human operators may apply sealant to a workpiece. However, using human operators may be more costly or more time consuming than desired. Further, human operators may be exposed to fumes from the sealant.

The illustrative embodiments recognize and take into account that an automated sealant application apparatus may reduce at least one of manufacturing cost, manufacturing time, or exposure time to the sealant for a human operator. An automated sealant application apparatus may apply at least one of substantially consistent sealant coverage or substantially consistent sealant thickness.

As used herein, the phrase "at least one of", when used with a list of items, means different combinations of one or more of the listed items may be used and only one of each item in the list may be needed. In other words, at least one of means any combination of items and number of items may be used from the list but not all of the items in the list are required. The item may be a particular object, thing, or a category.

For example, without limitation, "at least one of item A, item B, or item C" may include item A, item A and item B, or item B. This example also may include item A, item B, and item C or item B and item C. Of course, any combinations of these items may be present. In some illustrative examples, "at least one of" may be, for example, without limitation, two of item A; one of item B; and ten of item C; four of item B and seven of item C; or other suitable combinations.

Yet further, the illustrative embodiments recognize and take into account that during manufacturing, a workpiece may be associated with robotic equipment for movement. For example, a workpiece may be associated with a robotic arm. It may reduce at least one of manufacturing time or manufacturing cost to use the robotic arm to move the workpiece as sealant is applied to the workpiece.

Figure 1:
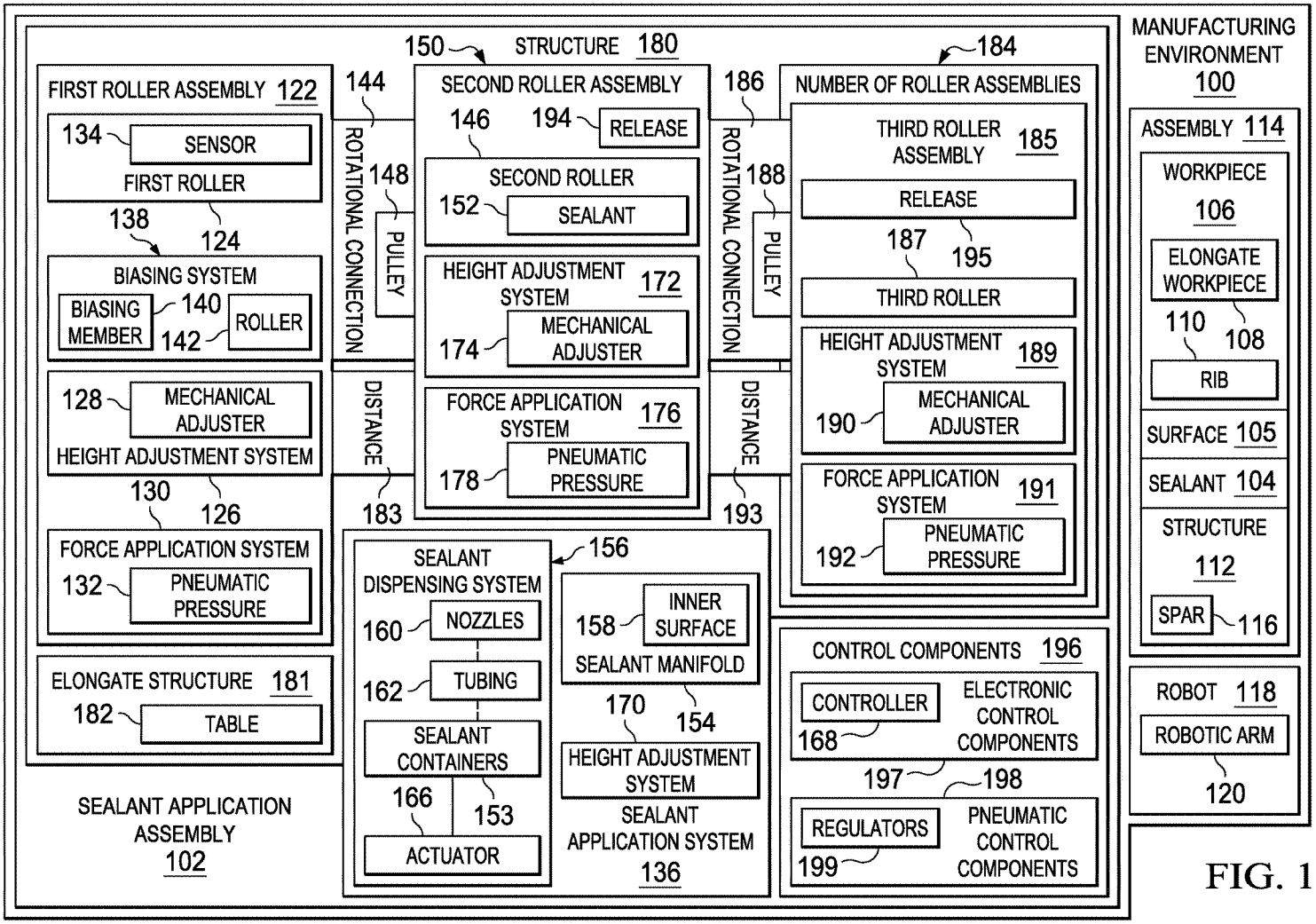
FIG. 1 is an illustration of a block diagram of a manufacturing environment in accordance with an illustrative embodiment.

With reference now to the figures, and in particular, with reference to FIG. 1, an illustration of a block diagram of a manufacturing environment is depicted in accordance with an illustrative embodiment. In this illustrative example, manufacturing environment 100 includes sealant application assembly 102 which may apply sealant 104 to surface 105 of workpiece 106. Workpiece 106 may take the form of elongate workpiece 108. In some illustrative examples, workpiece 106 may be rib 110.

Workpiece 106 may be fastened to structure 112 to form assembly 114. In some illustrative examples, structure 112 may be spar 116. In assembly 114, surface 105 may be fastened to structure 112.

To apply sealant 104 to workpiece 106, workpiece 106 may be moved relative to sealant application assembly 102. In some illustrative examples, robot 118 may move workpiece 106 relative to sealant application assembly 102. In some illustrative examples, robot 118 may take the form of robotic arm 120.

To apply sealant 104 to workpiece 106, robotic arm 120 may first move workpiece 106 over first roller assembly 122. First roller assembly 122 includes first roller 124. Height of first roller 124 within manufacturing environment 100 is controlled by height adjustment system 126. Height adjustment system 126 may be used to move the location of first roller 124 independently relative to other rollers of sealant application assembly 102. In some illustrative examples, height adjustment system 126 may be electronically controlled. In some illustrative examples, height adjustment system 126 may be mechanical adjuster 128. Mechanical adjuster 128 may be a knob, a screw, or other desirable type of adjuster. Height adjustment system 126 may limit the maximum height of first roller 124 within manufacturing environment 100.

Force application system 130 may apply force on first roller 124. Specifically, force application system 130 may apply upward force on first roller 124. Force application system 130 may force first roller 124 into contact with workpiece 106 by pneumatic pressure 132 as workpiece 106 moves over first roller 124.

First roller 124 rotates as workpiece 106 moves over first roller 124. Sensor 134 associated with first roller 124 senses movement of first roller 124. When sensor 134 senses movement, sealant application system 136 may be activated.

In some illustrative examples, first roller assembly 122 may also include biasing system 138. Biasing system 138 may bias workpiece 106 towards first roller 124. By biasing workpiece 106 towards first roller 124, biasing system 138 improves engagement between workpiece 106 and first roller 124.

Biasing system 138 includes biasing member 140 which supplies force in biasing system 138. In some illustrative examples, biasing member 140 may be a spring. The spring may be associated with roller 142. Roller 142 contacts workpiece 106.

By biasing workpiece 106 towards first roller 124, workpiece 106 may be biased into contact with first roller 124. By maintaining contact of workpiece 106 with first roller 124, first roller 124 may rotate as workpiece 106 moves over first roller 124. By maintaining contact of workpiece 106 with first roller 124, first roller 124 may transfer torque into rotational connection 144. Rotational connection 144 rotationally links first roller 124 and second roller 146. Rotational connection 144 may include pulley 148.

As workpiece 106 travels over first roller 124, torque is transferred into rotational connection 144 to move second roller 146 of second roller assembly 150. By rotationally connecting first roller 124 and second roller 146, first roller 124 and second roller 146 may rotate at substantially the same speed. As movement of first roller 124 is driven by movement of workpiece 106, first roller 124 may rotate at substantially the same speed as the movement of workpiece 106. As first roller 124 and second roller 146 are rotationally connected, second roller 146 may rotate at substantially the same speed as the movement of workpiece 106.

By moving second roller 146 and first roller 124 at substantially the same speed based on the speed of workpiece 106, slippage between each of first roller 124, second roller 146, and workpiece 106 may be reduced. In some illustrative examples, by moving second roller 146 and first roller 124 at substantially the same speed as workpiece 106, slippage between each of first roller 124, second roller 146 and workpiece 106 may be eliminated.

Second roller 146 may apply sealant 152 onto workpiece 106. Sealant 152 may be applied to second roller 146 by sealant application system 136. Specifically, sealant 152 may originate from sealant containers 153. When sensor 134 senses movement of first roller 124, sealant application system 136 may be activated to supply sealant 152 to second roller 146. The volumetric flow rate of sealant dispensed from sealant containers 153 may be related to the speed sensed by sensor 134. For example, for a greater speed sensed by sensor 134, a greater volume of sealant per time may be dispensed from sealant containers 153. As another example, for a lower speed sensed by sensor 134, a lesser volume of sealant per time may be dispensed from sealant containers 153. Sealant application system 136 includes sealant manifold 154 and sealant dispensing system 156. Sealant manifold 154 has inner surface 158 which mirrors second roller 146. Sealant 152 provided to sealant manifold 154 may be transferred to second roller 146. Sealant 152 may be supplied to sealant manifold 154 from sealant dispensing system 156. Sealant dispensing system 156 may include sealant containers 153, nozzles 160, tubing 162, and actuator 166.

Controller 168 may be associated with sealant dispensing system 156. Controller 168 may be implemented in software, hardware, firmware, or a combination thereof. When software is used, the operations performed by controller 168 may be implemented in program code configured to run on a processor unit. When firmware is used, the operations performed by controller 168 may be implemented in program code and data and stored in persistent memory to run on a processor unit. When hardware is employed, the hardware may include circuits that operate to perform the operations in controller 168.

In some illustrative examples, controller 168 may send signals to actuator 166 to control the flow of sealant 152. Actuator 166 may move to cause sealant to flow from sealant containers 153. Sealant from sealant containers 153 may travel through tubing 162 and to nozzles 160. Nozzles 160 dispense sealant onto inner surface 158 of sealant manifold 154.

As second roller 146 rotates, sealant 152 is applied to second roller 146 from inner surface 158 of sealant manifold 154. As workpiece 106 travels over second roller 146, sealant 152 is applied to workpiece 106.

Height adjustment system 170 may be used to change the height of sealant manifold 154 relative to second roller 146. By changing the height of sealant manifold 154, height adjustment system 170 may increase or decrease the distance between sealant manifold 154 and second roller 146. By increasing the distance between sealant manifold 154 and second roller 146, the thickness of sealant 152 on second roller 146 may also increase. Similarly, by decreasing the distance between sealant manifold 154 and second roller 146, the thickness of sealant 152 on second roller 146 may also decrease. As a result, the thickness of sealant 152 may be controlled at least in part by height adjustment system 170.

Height of second roller 146 within manufacturing environment 100 is controlled by height adjustment system 172. Height adjustment system 172 may be used to move the location of second roller 146 independently relative to other rollers of sealant application assembly 102. In some illustrative examples, height adjustment system 172 may be electronically controlled. Height adjustment system 172 may be mechanical adjuster 174. Mechanical adjuster 174 may be a knob, a screw, or other desirable type of adjuster. Height adjustment system 172 may limit the maximum height of second roller 146 within manufacturing environment 100. In some illustrative examples, the height of second roller 146 may be set within manufacturing environment 100 by height adjustment system 172 such that first roller 124 and second roller 146 have substantially the same height.

Force application system 176 may apply force on second roller 146. Specifically, force application system 176 may apply upward force on second roller 146. Force application system 176 may force second roller 146 into contact with workpiece 106 by pneumatic pressure 178 as workpiece 106 moves over second roller 146.

First roller assembly 122 and second roller assembly 150 may be associated with structure 180. When one component is "associated" with another component, the association is a physical association in the depicted examples. For example, a first component may be considered to be associated with a second component by being secured to the second component, bonded to the second component, mounted to the second component, welded to the second component, fastened to the second component, and/or connected to the second component in some other suitable manner. The first component also may be connected to the second component using a third component. The first component may also be considered to be associated with the second component by being formed as part of and/or an extension of the second component.

Structure 180 may take the form of elongate structure 181. In some illustrative examples, structure 180 may be table 182. In some illustrative examples, first roller assembly 122 and second roller assembly 150 may be mounted to structure 180. First roller assembly 122 and second roller assembly 150 may be associated with structure 180 such that first roller 124 and second roller 146 are separated by distance 183.

In some illustrative examples, distance 183 may be selected such that workpiece 106 contacts at least two rollers at a time. For example, distance 183 may be selected such that workpiece 106 contacts both first roller 124 and second roller 146. In other illustrative examples, distance 183 may be selected such that workpiece 106 contacts first roller 124, second roller 146, and at least one roller of number of roller assemblies 184.

After traveling over second roller assembly 150, workpiece 106 may move over number of roller assemblies 184. As used herein, a "number of" means one or more items. For example, number of roller assemblies 184 means one or more roller assemblies. As depicted, number of roller assemblies 184 may include third roller assembly 185. Although, as depicted, number of roller assemblies 184 has one roller assembly, in other illustrative examples, number of roller assemblies 184 may have any desirable number of roller assemblies. For example, number of roller assemblies 184 may have two roller assemblies. In another example, number of roller assemblies 184 may have three roller assemblies.

Rotational connection 186 rotationally links second roller 146 and third roller 187 of third roller assembly 185. Rotational connection 186 may include pulley 188.

As workpiece 106 travels over second roller 146, torque is transferred into rotational connection 186 to move third roller 187 of third roller assembly 185. By rotationally connecting second roller 146 and third roller 187, second roller 146 and third roller 187 may rotate at substantially the same speed. As movement of first roller 124 is driven by movement of workpiece 106, first roller 124 may rotate at substantially the same speed as the movement of workpiece 106. As first roller 124 and second roller 146 are rotationally connected, second roller 146 may rotate at substantially the same speed as the movement of workpiece 106. As second roller 146 and third roller 187 are rotationally connected, third roller 187 may also rotate at substantially the same speed as the movement of workpiece 106.

By moving second roller 146 and third roller 187 at substantially the same speed based on the speed of workpiece 106, slippage between each of second roller 146, third roller 187, and workpiece 106 may be reduced. In some illustrative examples, by moving second roller 146 and third roller 187 at substantially the same speed as workpiece 106, slippage between each of second roller 146, third roller 187, and workpiece 106 may be eliminated.

Third roller 187 may spread sealant 104 on surface 105 of workpiece 106. Third roller 187 may achieve a consistent coverage of sealant 104 on surface 105. Further, third roller 187 may achieve a consistent thickness of sealant 104 on surface 105. Sealant 104 may be sealant 152 applied by second roller 146 to workpiece 106.

Height of third roller 187 within manufacturing environment 100 is controlled by height adjustment system 189. Height adjustment system 189 may be used to move the location of third roller 187 independently relative to other rollers of sealant application assembly 102. In some illustrative examples, height adjustment system 189 may be electronically controlled. Height adjustment system 189 may be mechanical adjuster 190. Mechanical adjuster 190 may be a knob, a screw, or other desirable type of adjuster. Height adjustment system 189 may limit the maximum height of third roller 187 within manufacturing environment 100. In some illustrative examples, the height of third roller 187 may be set within manufacturing environment by height adjustment system 189 such that first roller 124, second roller 146, and third roller 187 have substantially the same height.

Force application system 191 may apply force on third roller 187. Specifically, force application system 191 may apply upward force on third roller 187. Force application system 191 may force third roller 187 into contact with workpiece 106 by pneumatic pressure 192 as workpiece 106 moves over third roller 187.

Third roller assembly 185 may be associated with structure 180. In some illustrative examples, third roller assembly 185 may be mounted to structure 180. Second roller assembly 150 and third roller assembly 185 may be associated with structure 180 such that second roller 146 and third roller 187 are separated by distance 193.

In some illustrative examples, distance 193 may be selected such that workpiece 106 contacts at least two rollers at a time. For example, distance 193 may be selected such that workpiece 106 contacts both second roller 146 and third roller 187. In other illustrative examples, distance 193 may be selected such that workpiece 106 contacts first roller 124, second roller 146, and third roller 187. In some other illustrative examples, distance 193 may be selected such that workpiece 106 contacts at least second roller 146, third roller 187, and at least one other roller of number of roller assemblies 184.

Second roller 146 and third roller 187 may both contact sealant. For example, second roller 146 is in contact with sealant 152 as second roller 146 applies sealant 152. As another example, third roller 187 is in contact with sealant 104 as third roller 187 spreads sealant 104. It may be undesirable for sealant to build up on second roller 146, third roller 187, or any other roller that is in contact with sealant. It may be desirable to clean sealant from second roller 146 and third roller 187 periodically.

Second roller assembly 150 may include release 194. In some illustrative examples, release 194 may take the form of a quick release. Release 194 may be used to remove second roller 146 from second roller assembly 150 to clean second roller 146. Third roller assembly 185 may include release 195. In some illustrative examples, release 195 may take the form of a quick release. Release 195 may be used to remove third roller 187 from third roller assembly 185 to clean third roller 187. In some illustrative examples, at least one of release 194 or release 195 is a quick release system. In some illustrative examples, at least one of second roller 146 and the third roller 187 is associated with a quick release system.

Sealant application assembly 102 may also include control components 196. Control components 196 may control application of utilities to at least one of first roller assembly 122, second roller assembly 150, third roller assembly 185, or sealant application system 136. For example, electronic control components 197 may provide control signals to at least one of height adjustment system 126, height adjustment system 170, height adjustment system 172, or height adjustment system 189 to control the height of components of sealant application assembly 102. In some illustrative examples, electronic control components 197 may include controller 168.

As another example, pneumatic control components 198 may provide control of at least one of pneumatic pressure 132, pneumatic pressure 178, or pneumatic pressure 192. In some illustrative examples, pneumatic control components 198 may include regulators 199.

Sealant application assembly 102 may use the movement of robotic arm 120 already holding workpiece 106 to provide motion of workpiece 106 through sealant application assembly 102. By varying the motion of workpiece 106 by robotic arm 120, sealant application assembly 102 may change the force of first roller 124, second roller 146, and third roller 187 against workpiece 106. Sealant application assembly 102 is configured to provide a roller speed for at least one of first roller 124, second roller 146, or third roller 187 to substantially match the speed with which robotic arm 120 passes workpiece 106 across sealant application assembly 102. Sealant application assembly 102 may use the path and velocity of workpiece 106 to control the application of sealant 104 to surface 105 of workpiece 106.

First roller 124, second roller 146, and third roller 187 are each rotationally linked to at least one other roller. As a result of rotational connection 144 and rotational connection 186, when at least one of first roller 124, second roller 146, or third roller 187 rotates, the remaining rollers rotate as well.

Figure 2:
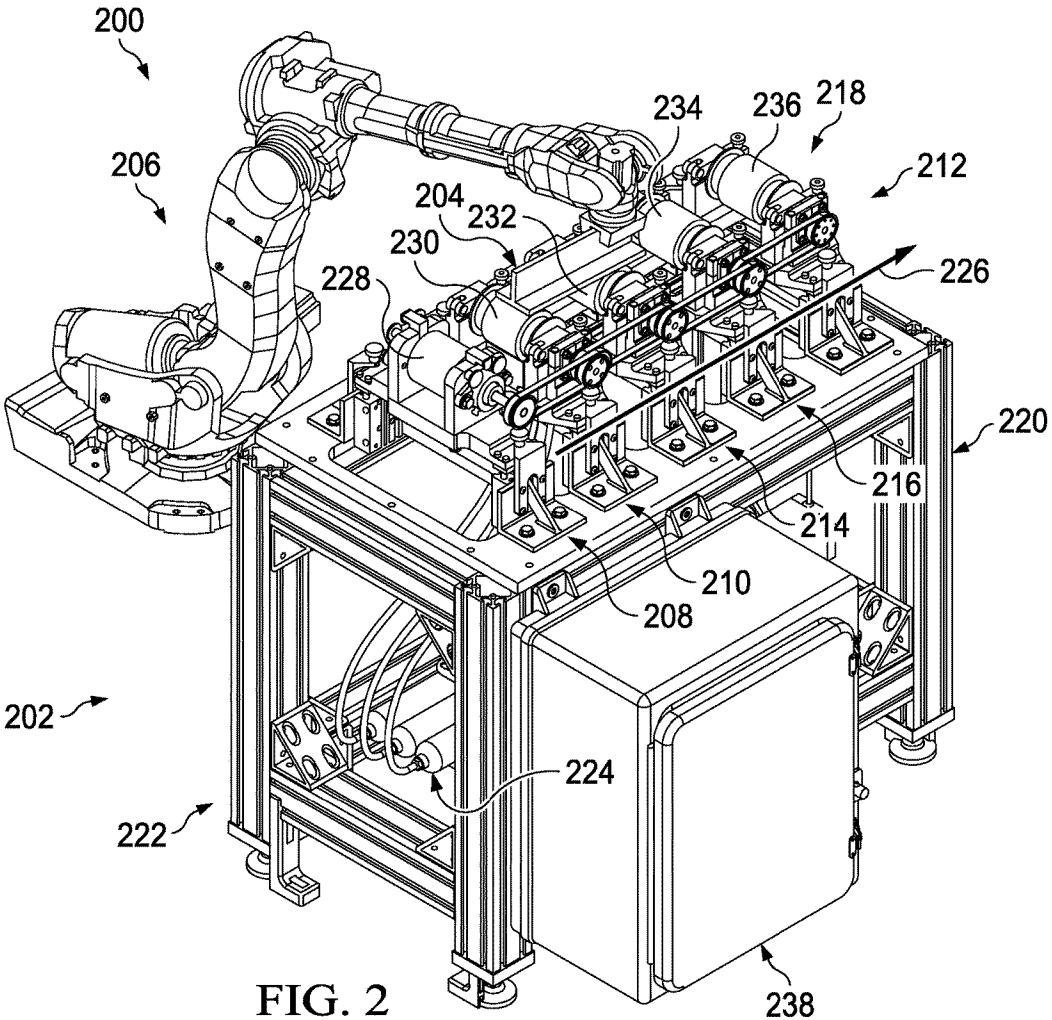
FIG. 2 is an illustration of a manufacturing environment in accordance with an illustrative embodiment.

Turning now to FIG. 2, an illustration of a manufacturing environment is depicted in accordance with an illustrative embodiment. Manufacturing environment 200 may be a physical implementation of manufacturing environment 100. Manufacturing environment 200 includes sealant application assembly 202, workpiece 204, and robotic arm 206. Robotic arm 206 may move workpiece 204 over sealant application assembly 202 to apply sealant to workpiece 204.

Sealant application assembly 202 includes first roller assembly 208, second roller assembly 210, and number of roller assemblies 212. In this illustrative example, number of roller assemblies 212 includes three roller assemblies. In this illustrative example, number of roller assemblies 212 includes third roller assembly 214, fourth roller assembly 216, and fifth roller assembly 218. Although, as depicted, number of roller assemblies 212 has three roller assemblies, in other illustrative examples, the number of roller assemblies may have any desirable number of roller assemblies. For example, number of roller assemblies 212 may have a single roller assembly. In another example, number of roller assemblies 212 may have two roller assemblies.

First roller assembly 208, second roller assembly 210, and number of roller assemblies 212 are associated with structure 220. Sealant dispensing system 222 is also associated with structure 220. Sealant dispensing system 222 includes sealant containers 224.

Robotic arm 206 may move workpiece 204 in direction 226 to apply sealant to workpiece 204. Workpiece 204 may first contact first roller 228 of first roller assembly 208. As workpiece 204 moves in direction 226, workpiece 204 may next contact second roller 230 of second roller assembly 210. Second roller 230 may apply sealant to workpiece 204. As depicted, workpiece 204 may contact third roller 232 of third roller assembly 214 and fourth roller 234 of fourth roller assembly 216. Third roller 232 and fourth roller 234 may spread sealant on workpiece 204 which was applied by second roller 230. Fifth roller 236 may also spread sealant on workpiece 204 when workpiece 204 moves across fifth roller 236.

Box 238 may house control components such as electronic control components 197 of FIG. 1 or pneumatic control components 198 of FIG. 1. Box 238 may also house connections such as tubing, wires, or other desirable forms of connections for supporting the components of sealant application assembly 202.

Figure 3:
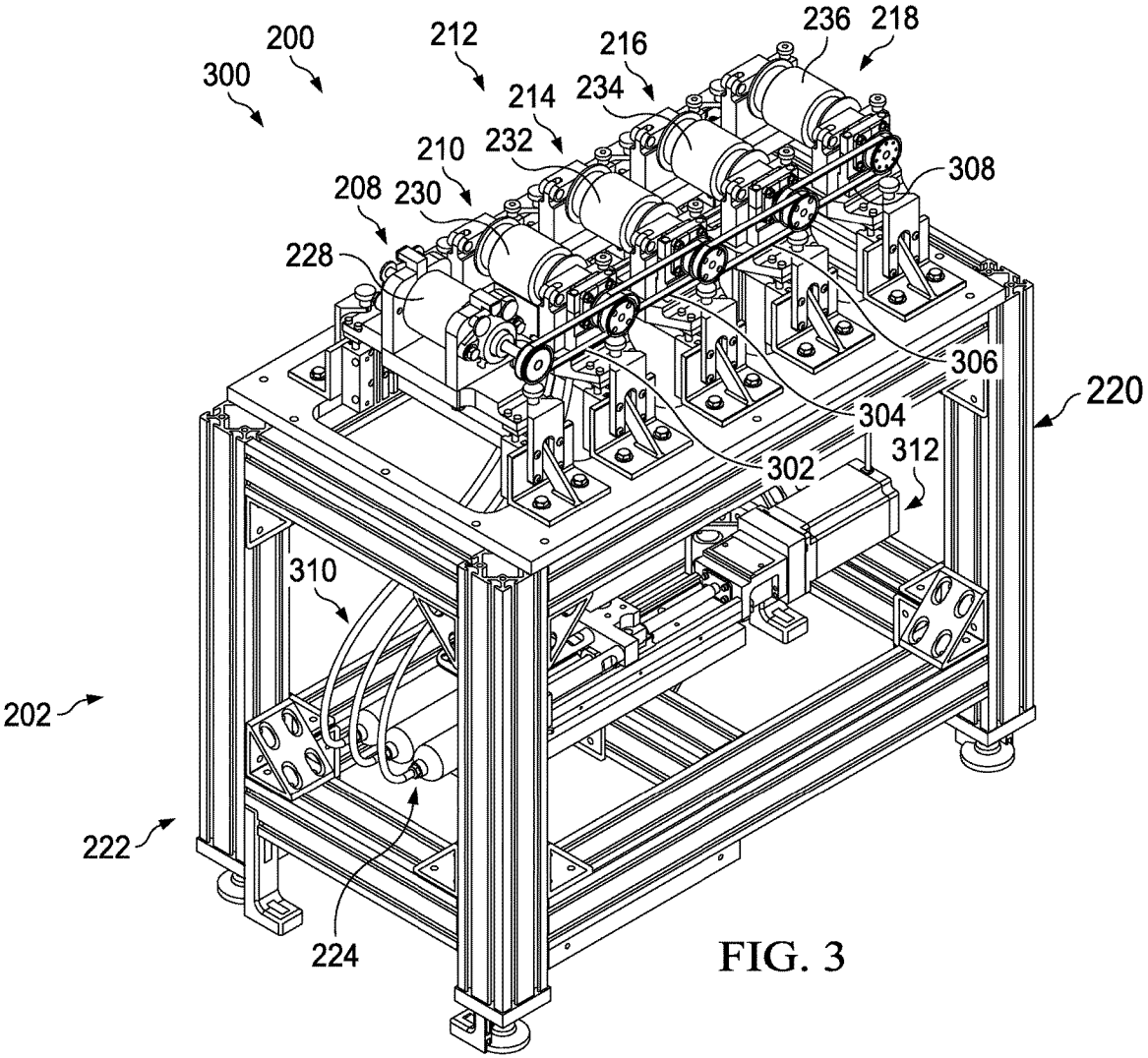
FIG. 3 is an illustration of a manufacturing assembly in accordance with an illustrative embodiment.
Figure 4:
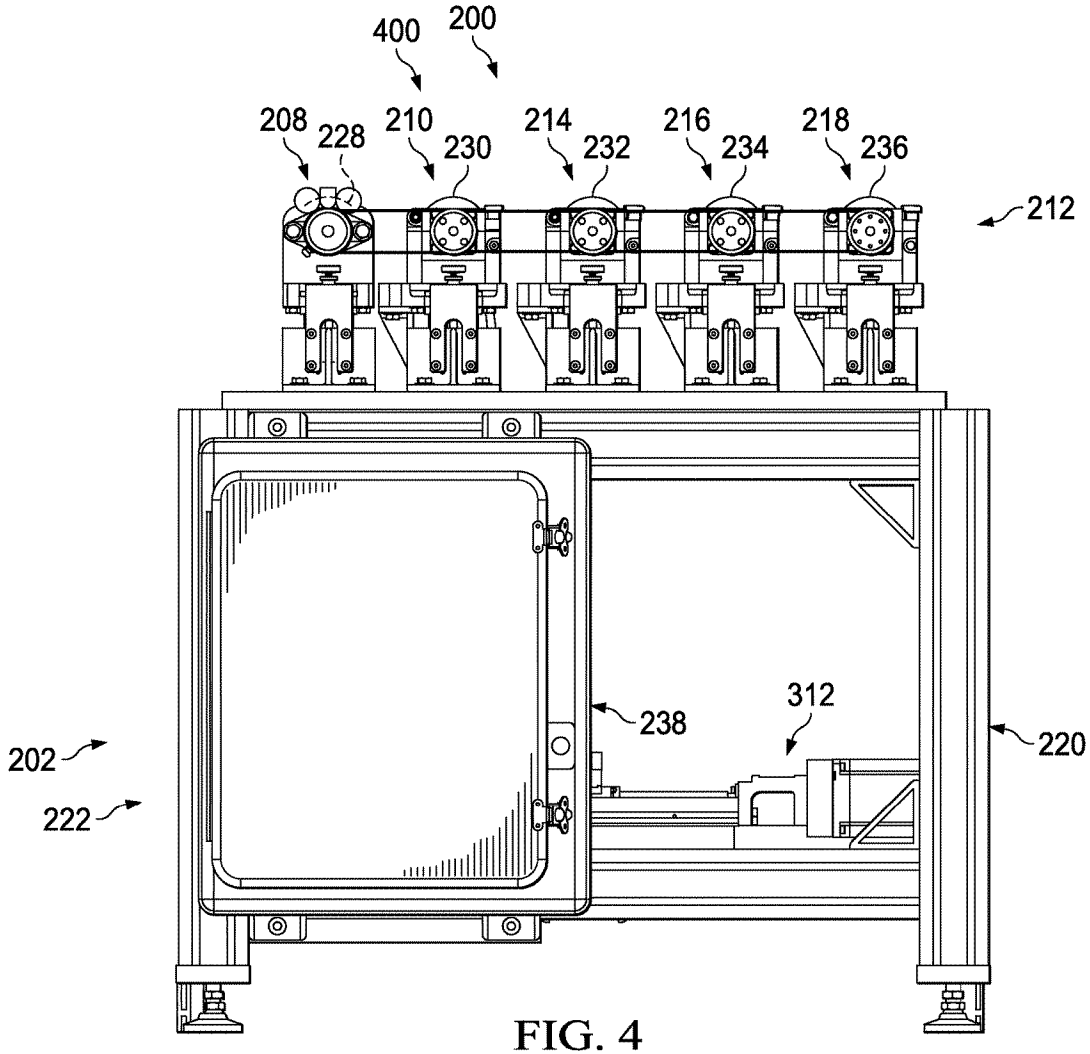
FIG. 4 is an illustration of a manufacturing assembly in accordance with an illustrative embodiment.
Figure 5:
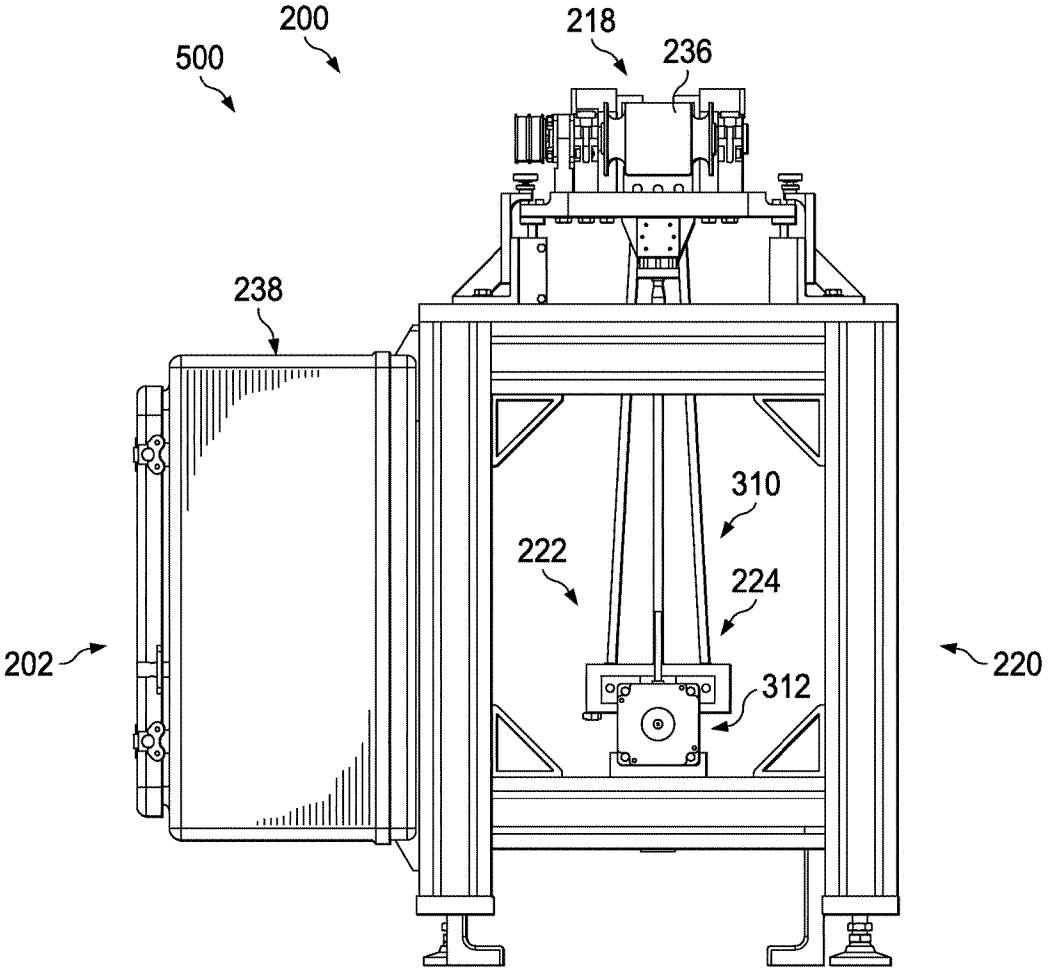
FIG. 5 is an illustration of a manufacturing assembly in accordance with an illustrative embodiment.
Figure 6:
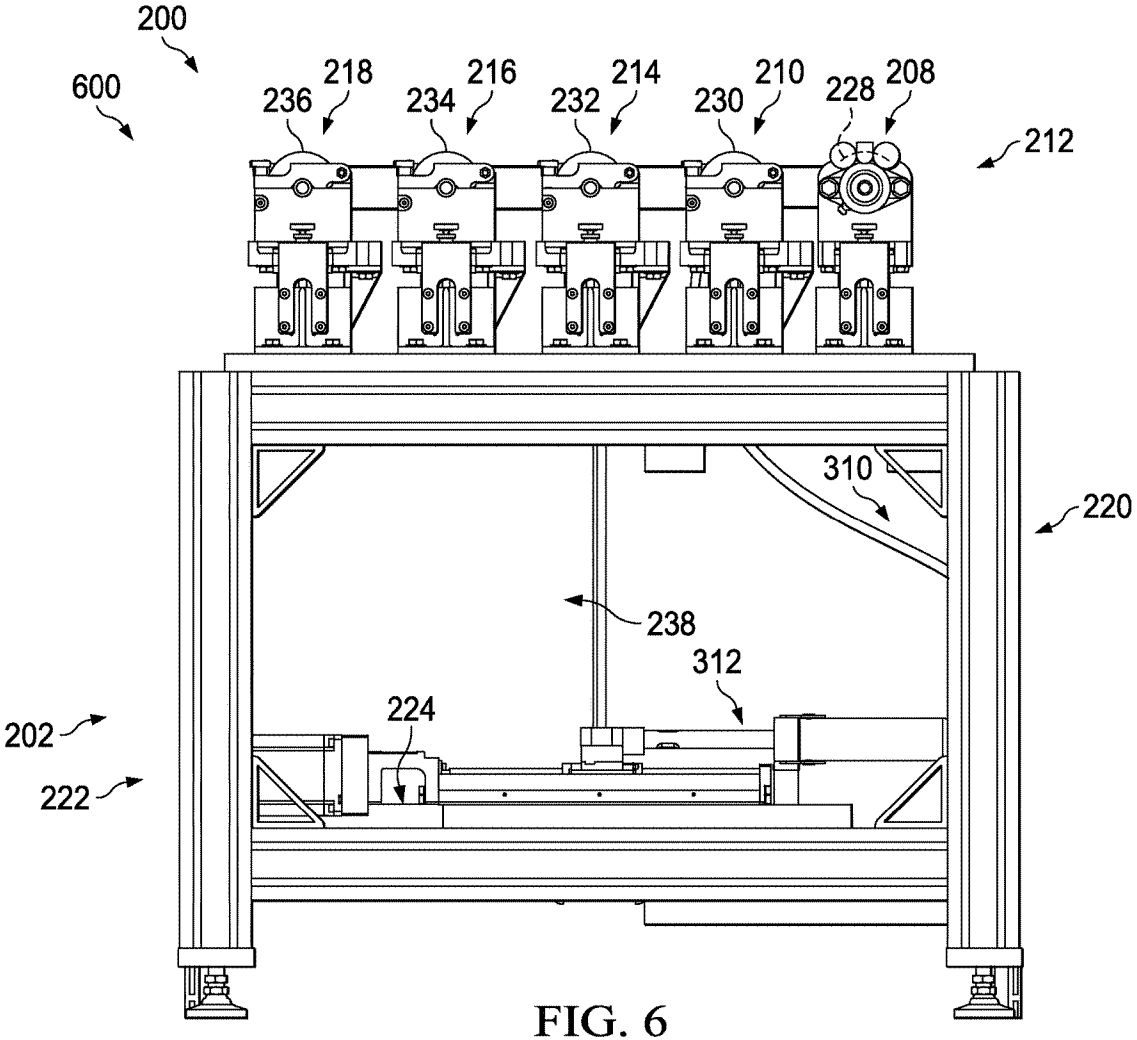
FIG. 6 is an illustration of a manufacturing assembly in accordance with an illustrative embodiment.

Turning now to FIG. 3, an illustration of a manufacturing assembly is depicted in accordance with an illustrative embodiment. View 300 is a view of manufacturing environment 200 without workpiece 204, robotic arm 206, or box 238.

As can be seen in view 300, first roller 228 is rotationally linked to second roller 230. As depicted, first roller 228 and second roller 230 are rotationally linked by pulley 302. Second roller 230 and third roller 232 are rotationally linked by pulley 304. Third roller 232 and fourth roller 234 are rotationally linked by pulley 306. Fourth roller 234 and fifth roller 236 are rotationally linked by pulley 308.

By rotationally linking first roller 228 and second roller 230, as a workpiece such as workpiece 204 of FIG. 2 is moved over first roller 228, first roller 228 may rotate. As first roller 228 rotates, second roller 230 rotates at the same speed as first roller 228. As a result of pulley 302, pulley 304, pulley 306, and pulley 308, as a workpiece travels across at least one of first roller 228, second roller 230, third roller 232, fourth roller 234, or fifth roller 236, rotating the respective roller, the remaining rollers also rotate. Although each of pulley 302, pulley 304, pulley 306, and pulley 308 are each positioned on the same side of structure 220, in some illustrative examples, at least one of pulley 302, pulley 304, pulley 306, and pulley 308 may be positioned on the opposite side of structure 220.

Pulley 302, pulley 304, pulley 306, and pulley 308 may reduce slippage of a workpiece relative to at least one of first roller 228, second roller 230, third roller 232, fourth roller 234, or fifth roller 236. In some illustrative examples, at least one of pulley 302, pulley 304, pulley 306, or pulley 308 may prevent slippage of a workpiece relative to at least one of first roller 228, second roller 230, third roller 232, fourth roller 234, or fifth roller 236.

In this illustrative example, sealant containers 224 of sealant dispensing system 222 are associated with tubing 310 and actuator 312. Actuator 312 may be a physical implementation of actuator 166 of FIG. 1. Actuator 166 may force sealant from sealant containers 224 through tubing 310 towards second roller assembly 210.

Figure 7:
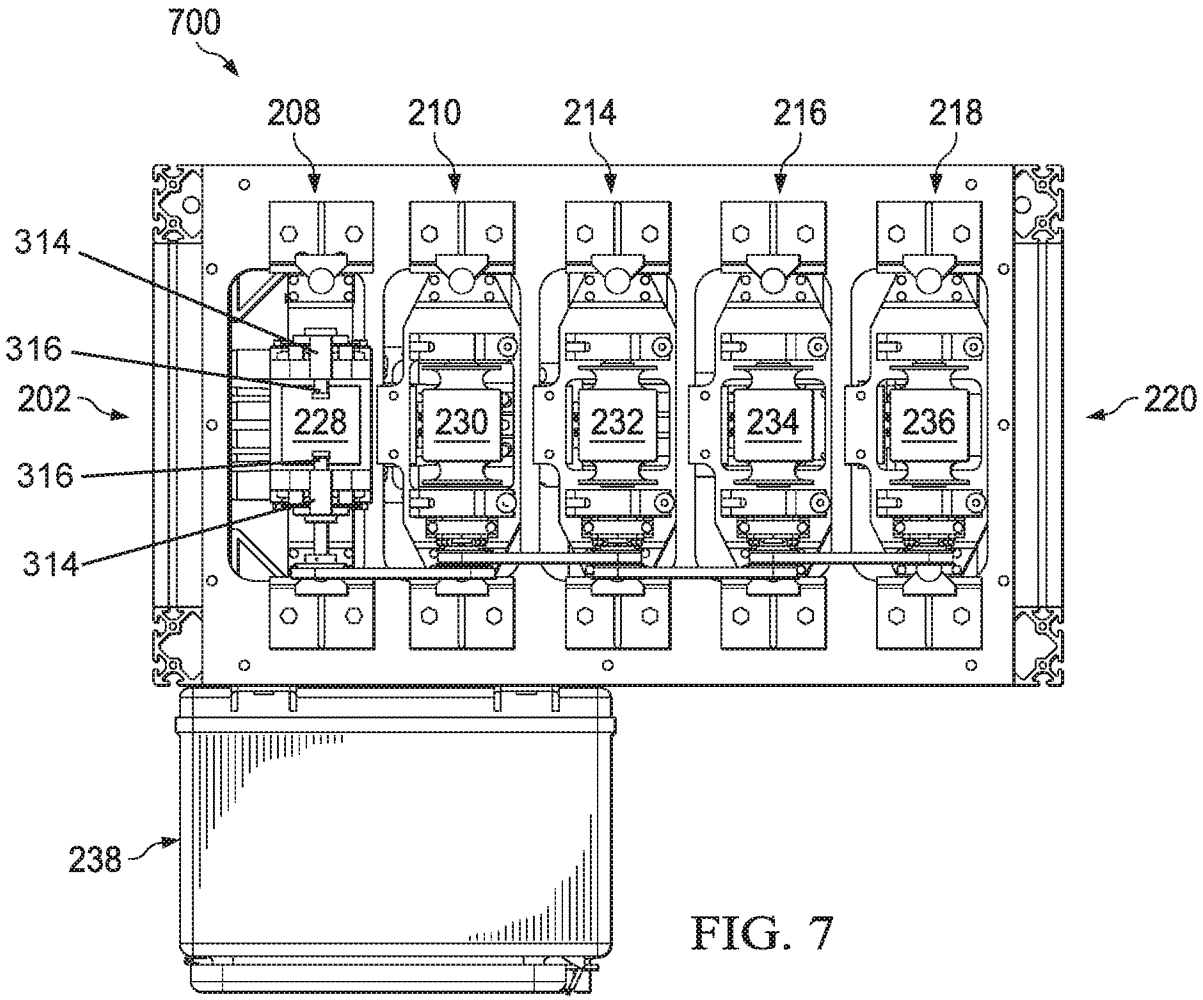
FIG. 7 is an illustration of a manufacturing assembly in accordance with an illustrative embodiment.

Biasing system 314 (see FIG. 7) is associated with first roller assembly 208. Biasing system 314 may bias a workpiece towards first roller assembly 208. For example, roller 316 of biasing system 314 may roll along a surface of a workpiece to restrict the movement of the workpiece away from first roller assembly 208. When the workpiece is a rib, roller 316 may roll along a flange of the rib to restrict the movement of the rib away from first roller assembly 208.

Turning now to FIGS. 4-7, an illustration of a manufacturing assembly is depicted in accordance with an illustrative embodiment. Specifically, FIGS. 4-7 show manufacturing environment 200 without workpiece 204 or robotic arm 206. Further, in FIGS. 4-7, pulley 302, pulley 304, pulley 306, and pulley 308 have been removed for illustrative purposes only. In view 400 of FIG. 4, a side view of sealant application assembly 202 is depicted. In view 500 of FIG. 5, a back view of sealant application assembly 202 is depicted. In view 600 of FIG. 6, a side view of sealant application assembly 202 is depicted. In view 700 of FIG. 7, a top view of sealant application assembly 202 is depicted.

Figure 8:
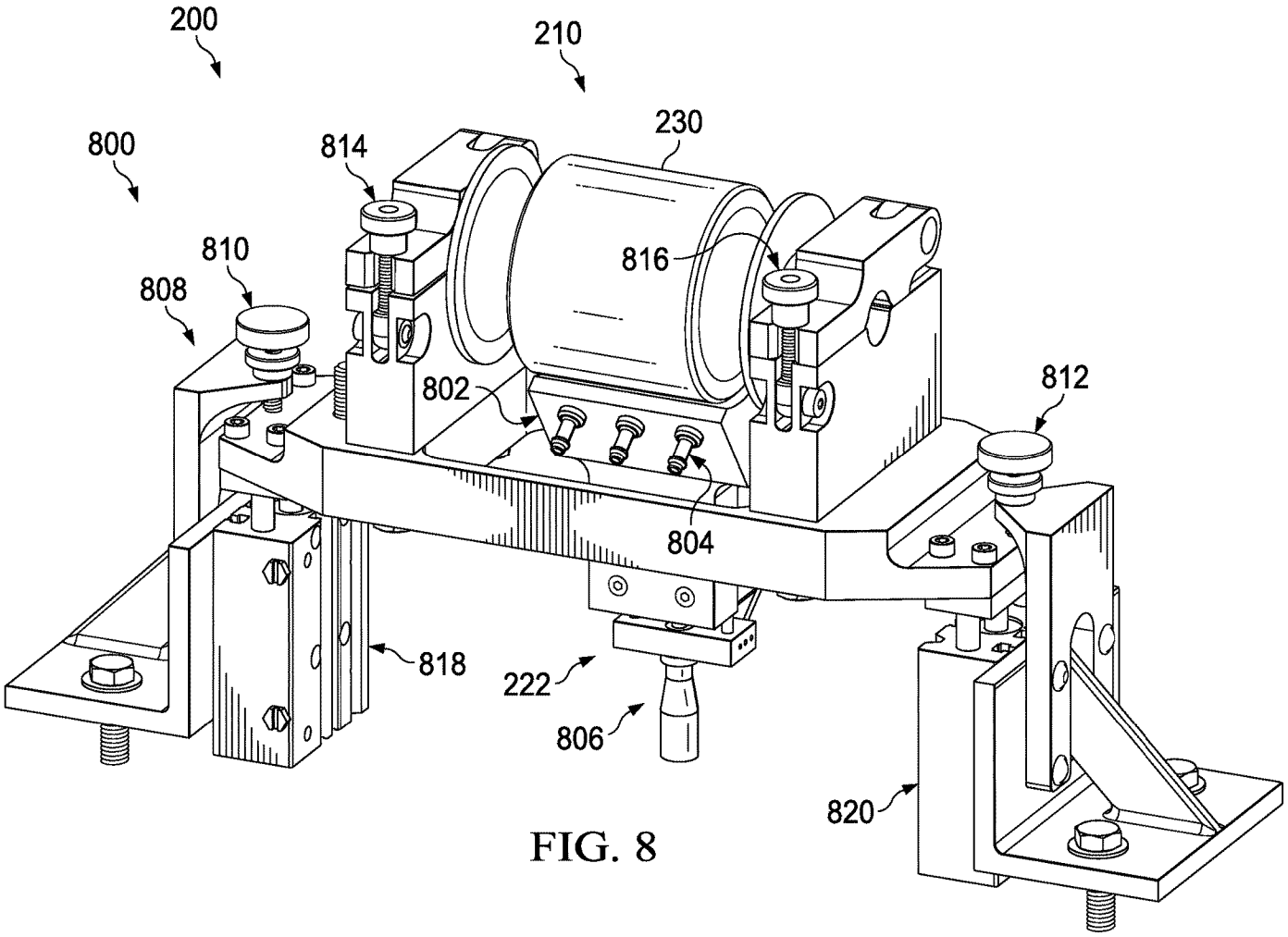
FIG. 8 is an illustration of a portion of a roller assembly in accordance with an illustrative embodiment.

Turning now to FIG. 8, an illustration of a portion of a roller assembly is depicted in accordance with an illustrative embodiment. View 800 depicts second roller assembly 210. As depicted, second roller assembly 210 is associated with sealant application system 801. Sealant application system 801 includes sealant dispensing system 222 of FIG. 2. As depicted, sealant application system 801 includes sealant manifold 802, nozzles 804, and height adjustment system 806. Nozzles 804 may be associated with tubing, such as tubing 310 of FIG. 3. Tubing 310 may provide sealant to nozzles 804. Nozzles 804 may deposit sealant within an inner surface of sealant manifold 802. The inner surface of sealant manifold 802 may substantially mirror second roller 230.

Height adjustment system 806 is associated with sealant manifold 802 of sealant application system 801. Height adjustment system 806 may adjust the distance between sealant manifold 802 and second roller 230. By adjusting the distance between sealant manifold 802 and second roller 230, height adjustment system 806 may adjust a thickness of sealant on second roller 230.

Height adjustment system 808 is associated with second roller 230. Height adjustment system 808 may adjust the height of second roller 230 relative to first roller 228, third roller 232, fourth roller 234, and fifth roller 236. Height adjustment system 808 includes knob 810 and knob 812. Knob 810 and knob 812 may be adjusted to change the height of second roller 230.

Second roller assembly 210 further includes release 814 and release 816. To clean second roller 230, release 814 and release 816 may be opened. As illustrated, release 814 and release 816 take the form of quick releases. At least one of third roller 232, fourth roller 234, and fifth roller 236 may have respective releases. In some illustrative examples, each of second roller 230, third roller 232, fourth roller 234, and fifth roller 236 may have the same type of releases.

Force application system 818 and force application system 820 may provide an upward force to second roller 230. Force application system 818 and force application system 820 may force second roller 230 into contact with a workpiece by pneumatic pressure as the workpiece moves over second roller 230. At least one of first roller 228, third roller 232, fourth roller 234, and fifth roller 236 may have respective force application systems. In some illustrative examples, each of first roller 228, second roller 230, third roller 232, fourth roller 234, and fifth roller 236 may have the same type of force application systems.

Figure 9:
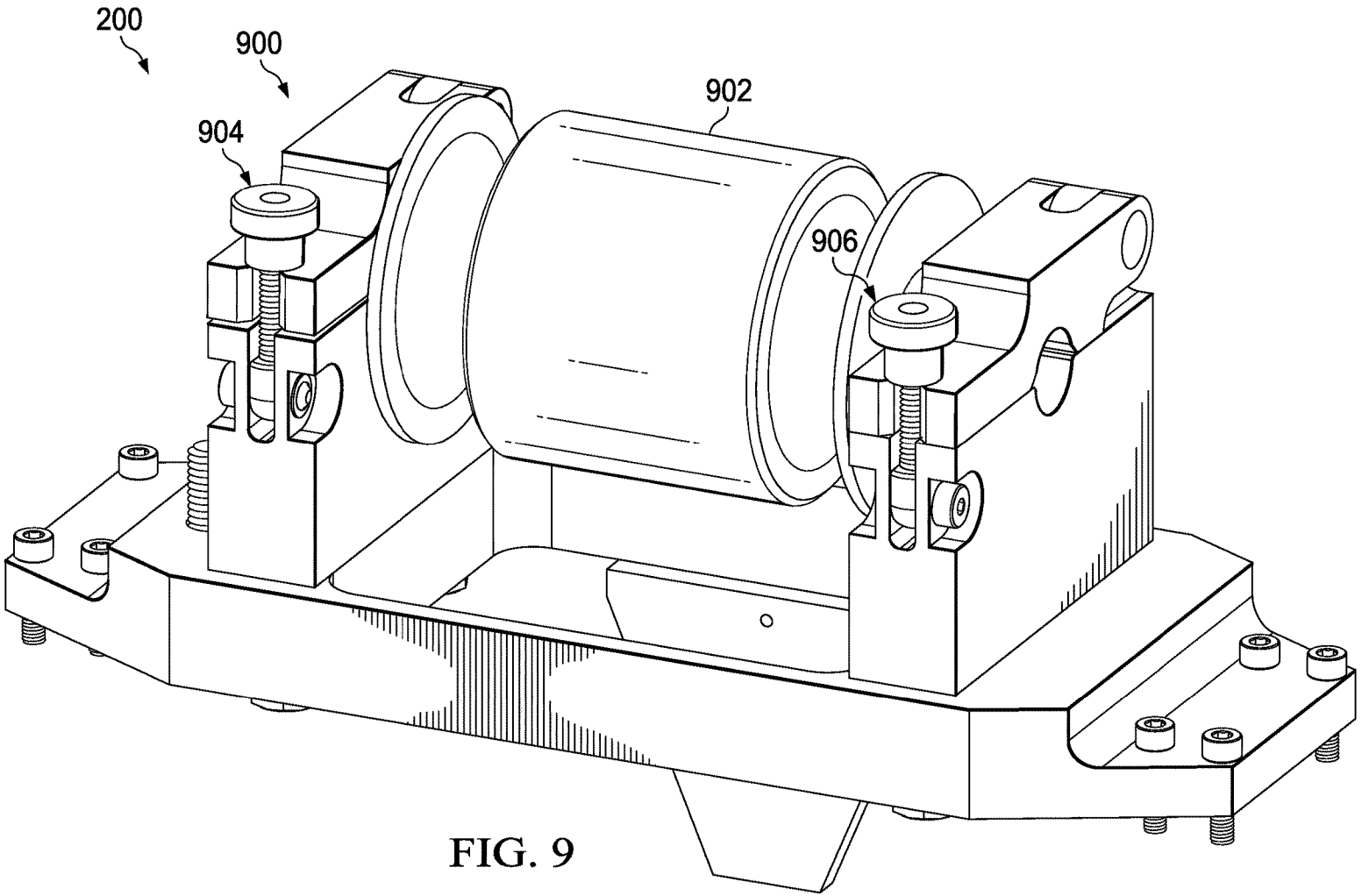
FIG. 9 is an illustration of a portion of a roller assembly in accordance with an illustrative embodiment.

Turning now to FIG. 9, an illustration of a portion of a roller assembly is depicted in accordance with an illustrative embodiment. Portion 900 may be a portion of one of second roller assembly 210 or any of number of roller assemblies 212. Portion 900 includes roller 902, release 904, and release 906. To clean roller 902, release 904 and release 906 may be opened. As illustrated, release 904 and release 906 take the form of quick releases. Quick releases may reduce the amount of time to remove roller 902.

The different components shown in FIGS. 2-9 may be combined with components in FIG. 1, used with components in FIG. 1, or a combination of the two. Additionally, some of the components in FIGS. 2-9 may be illustrative examples of how components shown in block form in FIG. 1 may be implemented as physical structures.

The illustration of the manufacturing environments in FIGS. 1-9 are not meant to imply physical or architectural limitations to the manner in which an illustrative embodiment may be implemented. Other components in addition to or in place of the ones illustrated may be used. Some components may be unnecessary. Also, the blocks are presented to illustrate some functional components. One or more of these blocks may be combined, divided, or combined and divided into different blocks when implemented in an illustrative embodiment.

For example, a splatter guard may be associated with at least one of second roller assembly 150 or third roller assembly 185 of FIG. 1. A splatter guard may reduce the amount of sealant undesirably lost within manufacturing environment 100. A splatter guard may reduce the amount of time dedicated to cleaning errant sealant within manufacturing environment 100.

As another example, a sealant remover may be associated with at least one of second roller assembly 150 or third roller assembly 185. A sealant remover may control the amount of sealant present on at least one of second roller 146 or third roller 187. A sealant remover may prevent an undesirable amount of sealant from collecting on at least one of second roller 146 or third roller 187. A sealant remover may leave a desirable amount of sealant on at least one of second roller 146 or third roller 187.

As yet a further example, although FIGS. 1 and 3 depict biasing system 138 and biasing system 314, these components may be optional. In some illustrative examples, a biasing system may not be associated with first roller assembly 122 or first roller assembly 208.

Yet further, controller 168 may send control signals to robotic arm 120 to control at least one of the direction or speed of movement of workpiece 106. In some illustrative examples, an additional controller may be present in the manufacturing environment to control at least one of the direction or speed of movement of workpiece 106.

Figure 10:
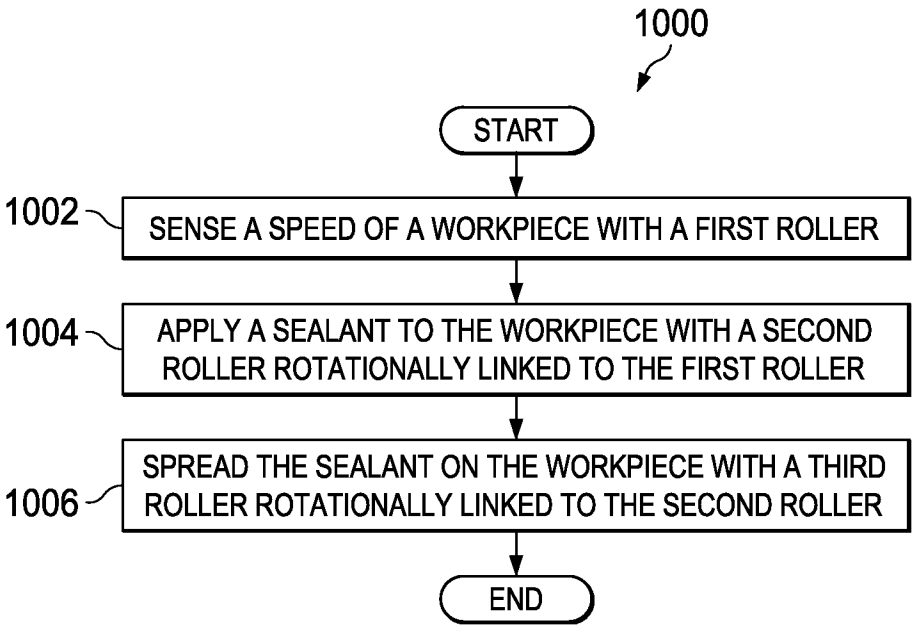
FIG. 10 is an illustration of a flowchart of a process for applying sealant to a workpiece in accordance with an illustrative embodiment.

Turning now to FIG. 10, an illustration of a flowchart of a process for applying sealant to a workpiece is depicted in accordance with an illustrative embodiment. Method 1000 may be performed using sealant application assembly 102 of FIG. 1. Method 1000 may be performed using sealant application assembly 202 of FIG. 2.

Method 1000 may comprise sensing a speed of a workpiece with a first roller (operation 1002). The speed of the workpiece may be sensed with a sensor associated with the first roller. The first roller may be first roller 228 of FIG. 2. In some illustrative examples, the sensor may be sensor 134 of FIG. 1. The sensor may be associated with the first roller by being attached to the inside of the first roller, attached to the side of the first roller, attached to a spindle of the first roller, or by being otherwise desirably coupled to the first roller.

Method 1000 may then apply a sealant to the workpiece with a second roller rotationally linked to the first roller (operation 1004). The second roller may be rotationally linked to the first roller by a rotational connection, such as rotational connection 144 of FIG. 1. In some illustrative examples, the rotational connection may be a pulley, such as pulley 302 of FIG. 3. The rotational connection may cause the first roller and the second roller to rotate at substantially the same speed. The speed may be regulated based on the speed of the workpiece moving over the first roller.

Method 1000 may then spread the sealant on the workpiece with a third roller rotationally linked to the second roller (operation 1006). Afterwards, the process may terminate. The third roller may be rotationally linked to the second roller by a rotational connection such as rotational connection 186 of FIG. 1. In some illustrative examples, the rotational connection may be a pulley, such as pulley 304 of FIG. 3. The rotational connection may cause the second roller and the third roller to rotate at substantially the same speed. When the first roller and the second roller are rotatably connected, the speed of the third roller may be regulated based on the speed of the workpiece moving over the first roller.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram. Further, some blocks may not be implemented.

For example, method 1000 may further comprise moving the workpiece over the first roller using a robot. The robot may be a robotic arm such as robotic arm 206 of FIG. 2. In some illustrative examples, method 1000 may also bias the workpiece into contact with the first roller using a biasing system. In some illustrative examples, method 1000 may also translate torque into a pulley system rotationally linking the second roller and the first roller to drive the second roller. The biasing system may allow for the first roller to transfer a desirable amount of torque into the rotational connection. By translating torque into a pulley system, the second roller may be moved at substantially the same speed as the first roller. By moving the second roller and the first roller at substantially the same speed based on the speed of the workpiece, slippage between the rollers and the workpiece may be reduced. In some illustrative examples, by moving the second roller and the first roller at substantially the same speed as the workpiece, slippage between the rollers and the workpiece may be eliminated.

In some illustrative examples, method 1000 may also force at least one of the first roller, the second roller, and the third roller into contact with the workpiece by pneumatic pressure. The pneumatic pressure may be provided by at least one force application system.

In some illustrative examples, method 1000 may also apply sealant to the second roller using a sealant application system associated with the second roller. The sealant application system may comprise a sealant manifold having an inner surface substantially complementary to the second roller and a sealant dispensing system.

Thus, the illustrative embodiments may provide a method and apparatus for applying a sealant to a workpiece. The sealant application assembly includes a first roller assembly that rotates the remaining roller assemblies prior to application of the sealant to a workpiece. A second roller assembly applies sealant to the workpiece as it translates over a second roller of the second roller assembly. A number of roller assemblies spread the sealant over the surface of the workpiece. By spreading the sealant over the surface of the workpiece, a consistent thickness of sealant may be achieved. Further, by spreading the sealant over the surface of the workpiece, a consistent coverage of sealant may be achieved.

A robotic arm used to transport the workpiece during at least one of assembly or manufacturing may be used to move the workpiece over the sealant application assembly. The robotic arm may control the direction and speed of movement of the workpiece. The direction and speed of movement of the workpiece may control the application of sealant to the workpiece.

By using the sealant application assembly, at least one of manufacturing time or manufacturing cost may be reduced. For example, labor costs may be reduced. Further, by using the sealant application assembly, human operators may reduce exposure to the sealant and sealant fumes.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A system for applying a sealant to a workpiece, the system comprising:

a first roller having a sensor that senses a speed of the workpiece while the workpiece is in contact with the first roller and moving relative to the first roller causing the first roller to rotate, wherein the sensor senses the speed of the workpiece from a rotation of the first roller;

a second roller that causes the sealant on the second roller to be applied to a surface of the workpiece when the workpiece is in contact with the second roller and moving relative to the second roller, wherein the second roller is rotationally linked to the first roller; and a third roller that causes the sealant on the surface of the workpiece to spread on the surface when the workpiece is in contact with the third roller and moving relative to the third roller, wherein the third roller is rotationally linked to the second roller;

a sealant application system associated with the second roller that provides a sealant to a sealant manifold for application of the sealant to the second roller;

a robotic arm that grips the workpiece and controls a direction and a speed of a movement of the workpiece over the sealant application system.

2. The system of claim 1, wherein at least one of the first roller, the second roller, and the third roller is forced into contact with the workpiece by pneumatic pressure from a force application system that provides an upward force to at least one of the first roller, the second roller, and the third roller.

3. The system of claim 2, wherein the pneumatic pressure applied to each of the at least one of the first roller, the second roller, and the third roller is individually controllable.

4. The system of claim 2, wherein the pneumatic pressure applied to each of the at least one of the first roller, the second roller, and the third roller is equal.

5. The system of claim 1 further comprising:

a biasing system for biasing the workpiece into contact with the first roller.

6. The system of claim 1 further comprising:

a fourth roller that causes the sealant on the surface of the workpiece to spread on the surface when the workpiece is in contact with the fourth roller and moving relative to the fourth roller, wherein the third roller is rotationally linked to the second roller.

7. The system of claim 1 further comprising:

a structure associated with the first roller, the second roller, and the third roller such that the first roller is separated from the second roller by a first distance and the second roller is separated from the third roller by a second distance.

8. The system of claim 7, wherein the first distance and the second distance are substantially the same.

9. The system of claim 1 further comprising:

a pulley system that rotationally links the second roller to the first roller to drive the second roller so that the second roller moves at substantially the same speed as the first roller.

10. The system of claim 1, wherein at least one of the second roller and the third roller is associated with a quick release system.

11. A system for applying a sealant to a workpiece, the system comprising:

a first roller configured to sense a speed of the workpiece by a sensor, such that in operation, the first roller senses the speed of the workpiece;

a biasing system associated with the first roller, the biasing system configured to bias the workpiece into contact with the first roller, such that in operation, the biasing system biases the workpiece into contact with the first roller;

a second roller configured to apply the sealant to the workpiece, such that in operation, the second roller applies the sealant to the workpiece, wherein the second roller is rotationally linked to the first roller;

a sealant application system associated with the second roller, the sealant application system comprising:

a sealant manifold having an inner surface substantially complementary to the second roller; and a sealant dispensing system; and a third roller configured to spread the sealant across the workpiece, such that in operation, the third roller spreads the sealant across the workpiece, wherein the third roller is rotationally linked to the second roller;

a pulley system rotationally linking the second roller and the first roller to drive the second roller so that the second roller moves at substantially the same speed as the first roller;

a number of force application systems that provide an upward force to the second roller to force the second roller into contact with a workpiece by pneumatic pressure as the workpiece moves over second roller; and a robotic arm that grips the workpiece and controls a direction and a speed of a movement of the workpiece over the sealant application system;

wherein the sealant application system is configured to provide a roller speed for at least one of the first roller, the second roller, or the third roller that substantially matches the speed of the movement of the workpiece across the sealant application system.

12. The system of claim 11 further comprising:

a fourth roller configured to spread the sealant across the workpiece, such that in operation, the fourth roller spreads the sealant across the workpiece, wherein the fourth roller is rotationally linked to the third roller.

13. The system of claim 12, wherein at least one of the second roller and the third roller is associated with a quick release system.

14. A method for applying sealant to a workpiece, the method comprising:

sensing a speed of the workpiece with a first roller;

applying the sealant to the workpiece with a second roller rotationally linked to the first roller; and spreading the sealant on the workpiece with a third roller rotationally linked to the second roller;

wherein the first roller has a sensor that senses a speed of the workpiece while the workpiece is in contact with the first roller and moving relative to the first roller causing the first roller to rotate, wherein the sensor senses the speed of the workpiece from a rotation of the first roller;

wherein the second roller causes the sealant on the second roller to be applied to a surface of the workpiece when the workpiece is in contact with the second roller and moving relative to the second roller, wherein the second roller is rotationally linked to the first roller;

wherein the third roller causes the sealant on the surface of the workpiece to spread on the surface when the workpiece is in contact with the third roller and moving relative to the third roller, wherein the third roller is rotationally linked to the second roller;

wherein a sealant application system associated with the second roller provides the sealant to a sealant manifold for application of the sealant to the second roller; and wherein a robotic arm grips the workpiece and controls a direction and a speed of a movement of the workpiece over the sealant application system.

15. The method of claim 14 further comprising:

moving the workpiece over the first roller using a robot.

16. The method of claim 14 further comprising:

biasing the workpiece into contact with the first roller using a biasing system.

17. The method of claim 14 further comprising:

forcing at least one of the first roller, the second roller, and the third roller into contact with the workpiece by pneumatic pressure.

18. The method of claim 14 further comprising:

applying the sealant to the second roller using the sealant manifold having an inner surface substantially complementary to the second roller and a sealant dispensing system.

19. The method of claim 14 further comprising:

translating torque into a pulley system rotationally linking the second roller and the first roller to drive the second roller.

* * * * *